US007520450B2

(12) United States Patent
Cedoz et al.

(10) Patent No.: US 7,520,450 B2
(45) Date of Patent: Apr. 21, 2009

(54) ELECTRICAL CONNECTIONS FOR COATING MATERIAL DISPENSING EQUIPMENT

(75) Inventors: Roger T. Cedoz, Curtice, OH (US); David M. Seitz, Riga, MI (US)

(73) Assignee: Illinois Tool Works Inc., Glenview, IL (US)

( * ) Notice: Subject to any disclaimer, the term of this patent is extended or adjusted under 35 U.S.C. 154(b) by 302 days.

(21) Appl. No.: 11/545,435

(22) Filed: Oct. 10, 2006

(65) Prior Publication Data

US 2008/0083846 A1 Apr. 10, 2008

(51) Int. Cl.

| | |
|---|---|
| ***B05B 5/04*** | (2006.01) |
| ***B05B 5/00*** | (2006.01) |
| ***B05B 5/025*** | (2006.01) |
| ***B05B 5/053*** | (2006.01) |

(52) U.S. Cl. ..... 239/700; 239/223; 239/703

(58) Field of Classification Search ..... 239/3, 239/7, 223, 224, 690, 699, 700–704, 706–708; 118/620, 621, 627, 629

See application file for complete search history.

(56) References Cited

U.S. PATENT DOCUMENTS

| | | | |
|---|---|---|---|
| 2,890,388 | A | 6/1959 | Croskey et al. |
| 2,960,273 | A | 11/1960 | Croskey et al. |
| 3,393,662 | A | 7/1968 | Blackwell |
| 3,408,985 | A | 11/1968 | Sedlacsik, Jr. |
| 3,851,618 | A | 12/1974 | Bentley |
| 3,875,892 | A | 4/1975 | Gregg et al. |
| 3,894,272 | A | 7/1975 | Bentley |
| 3,952,951 | A | 4/1976 | Raetz et al. |
| 4,075,677 | A | 2/1978 | Bentley |
| 4,114,810 | A | 9/1978 | Masuda |
| 4,143,819 | A | 3/1979 | Hastings |
| 4,187,527 | A | 2/1980 | Bentley |
| 4,324,812 | A | 4/1982 | Bentley |
| 4,369,924 | A | 1/1983 | Morishita et al. |
| 4,481,557 | A | 11/1984 | Woodruff |
| 4,485,427 | A | 11/1984 | Woodruff et al. |
| 4,745,520 | A | 5/1988 | Hughey |
| 4,760,965 | A | 8/1988 | Schneider |
| 4,771,949 | A | 9/1988 | Behr et al. |

(Continued)

FOREIGN PATENT DOCUMENTS

| | | |
|---|---|---|
| DE | 43 35 507 A1 | 4/1995 |

(Continued)

*Primary Examiner*—Darren W Gorman
(74) *Attorney, Agent, or Firm*—Barnes & Thornburg LLP

(57) ABSTRACT

A rotary atomizer includes a motor for spinning an output shaft. At least a portion of the shaft is electrically relatively non-insulative. An atomizing device is mounted on the shaft for rotation therewith. A passageway extends the length of the shaft. A feed tube extends through the passageway for supplying a coating material to be atomized to the atomizing device. At least a portion of the feed tube in contact with the coating material to be atomized as the coating material to be atomized flows through the feed tube toward the atomizing device is electrically relatively non-insulative. The atomizer further includes a device for promoting electrical charging of the coating material to be atomized as the coating material to be atomized is in contact with the electrically relatively non-insulative at least a portion of the feed tube.

9 Claims, 3 Drawing Sheets

U.S. PATENT DOCUMENTS

| | | | | |
|---|---|---|---|---|
| 4,811,906 | A | | 3/1989 | Prus |
| 4,852,810 | A | | 8/1989 | Behr et al. |
| 4,872,616 | A | | 10/1989 | Behr et al. |
| 4,955,960 | A | | 9/1990 | Behr et al. |
| 5,085,373 | A | | 2/1992 | Behr et al. |
| 5,159,544 | A | | 10/1992 | Hughey et al. |
| 5,474,236 | A | | 12/1995 | Davis et al. |
| 5,622,563 | A | | 4/1997 | Howe et al. |
| 5,633,306 | A | | 5/1997 | Howe et al. |
| 5,662,278 | A | | 9/1997 | Howe et al. |
| 5,947,377 | A | * | 9/1999 | Hansinger et al. ..... 239/3 |
| 5,978,244 | A | | 11/1999 | Hughey |
| 6,144,570 | A | | 11/2000 | Hughey |
| 6,423,142 | B1 | | 7/2002 | Hughey |
| 6,562,137 | B2 | | 5/2003 | Hughey |
| 6,896,211 | B2 | | 5/2005 | Seitz |
| 2004/0135016 | A1 | | 7/2004 | Baumann et al. |
| 2004/0233592 | A1 | | 11/2004 | Oh et al. |
| 2006/0007609 | A1 | | 1/2006 | Oh et al. |

FOREIGN PATENT DOCUMENTS

| | | |
|---|---|---|
| EP | 0 178 746 | 4/1986 |
| EP | 0796663 B1 | 3/1997 |
| EP | 0 796 663 A2 | 9/1997 |

* cited by examiner

ELECTRICAL CONNECTIONS FOR COATING MATERIAL DISPENSING EQUIPMENT

FIELD OF THE INVENTION

This invention relates to coating material dispensing equipment. It is disclosed in the context of electrostatically aided coating material atomization and dispensing equipment, but is believed to have application in other fields as well.

BACKGROUND OF THE INVENTION

As used in this application, terms such as "electrically relatively conductive" and "electrically relatively non-insulative" refer to a broad range of conductivities electrically more conductive than materials described as "electrically relatively non-conductive" and "electrically relatively insulative." Terms such as "electrically semiconductive" refer to a broad range of conductivities between electrically relatively conductive and electrically relatively non-conductive.

Various types of electrostatically aided coating material atomizing and dispensing equipment are known. There are, for example, the devices and systems illustrated and described in U.S. Pat. Nos. 6,896,211; 5,474,236; U.S. Pat. No. 4,811,906; U.S. Pat. No. 4,369,924; published U.S. patent application 2004/0135016 A1; EP 0796663; EP 0178746; DE 4335507, and references cited in each of these.

In electrostatically-aided coating material dispensing applications for dispensing waterborne, or water-base, coating materials, the dispensing device, or atomizer, and the coating material supply are both typically held at or near ground potential. An external charging device, such as, for example, a device of the type illustrated and described in U.S. Pat. Nos. 5,085,373; 4,955,960; 4,872,616; 4,852,810; 4,771,949; 4,760,965; 4,143,819; 4,114,810; 3,408,985; 3,952,951; 3,393,662; 2,960,273; and, 2,890,388 provides an electric field through which atomized particles of the water-base, or other electrically non-insulative coating material pass between the atomizing device and the target to be coated by the atomized particles.

The grounded or approximately grounded components of the atomizer thus provide ground, or approximately ground, terminals of the electric field, one of the terminals of which is the electrodes of the indirect charging apparatus. The field contains ions through which the atomized coating material particles pass, picking up charges from the ions. The thus-charged coating material particles are attracted to grounded or near ground objects, such as the target(s) to be coated which is (are) typically conveyed past the dispensing device on a grounded or near-ground conveyor that thus also forms a terminal of the field. In a typical coating material atomization and dispensing device of this type, the ground or approximately ground condition established on components of the atomizer depends upon continuity of the non-insulative fluid stream between the atomizer and the coating material supply. However, discontinuities such as gaps and voids in the coating material stream may develop between the coating material supply source and the atomizer. Thus, fluid streams may vary in electrical conductivity and/or may not be very effective in establishing and maintaining ground paths.

In rotary atomizers with air bearing spindles, devices have been invented to bridge the gaps created by the air bearing between the stationary atomizer drive motor components and the rotating shaft and between the air bearing and its housing. However, there is typically by necessity a gap between the rotating shaft and the fluid delivery tube which typically extends through the interior of the rotating shaft. See, for example, U.S. Pat. No. 6,896,211.

Similar concerns arise in direct charging coating material dispensing systems for dispensing electrically non-conductive coating materials, such as, for example, typical volatile organic solvent-base coating materials. In such systems, the atomizer is at high magnitude, typically negative, potential. The fluid supply typically is at ground or a low magnitude potential, but grounding of the atomizer through the column of coating material extending between the coating material source and the atomizer is generally avoided because most such organic solvent-base coating materials are electrically relatively non-conductive. The coating material feed tube through which the column of coating material being dispensed is delivered to the bell cup and the inside surfaces of the bell cup are electrically relatively non-insulative and are coupled to the high magnitude potential source. Charge transfer from the atomizer to the coating material being dispensed typically occurs as the coating material flows through, and in direct contact with, the coating material feed tube and across the inside surface of the bell cup prior to atomization.

DISCLOSURE OF THE INVENTION

According to an aspect of the invention, a rotary atomizer includes a motor for spinning an output shaft. At least a portion of the shaft is electrically relatively non-insulative. An atomizing device is mounted on the shaft for rotation therewith. A passageway extends the length of the shaft. A feed tube extends through the passageway for supplying a coating material to be atomized to the atomizing device. At least a portion of the feed tube in contact with the coating material to be atomized as the coating material to be atomized flows through the feed tube toward the atomizing device is electrically relatively non-insulative. The atomizer further includes a device for promoting electrical charging of the coating material to be atomized as the coating material to be atomized is in contact with the electrically relatively non-insulative at least a portion of the feed tube. The device for promoting electrical charging of the coating material includes an electrically relatively non-insulative first portion in sufficiently close proximity to the electrically relatively non-insulative at least a portion of the shaft to provide relatively low resistance electrical charge transfer between the first portion and the electrically relatively non-insulative at least a portion of the shaft. The device for promoting electrical charging of the coating material further includes an electrically relatively non-insulative second portion extending in sufficiently close proximity to the electrically relatively non-insulative at least a portion of the feed tube to provide relatively low resistance electrical charge transfer between the second portion and the electrically relatively non-insulative at least a portion of the feed tube. The first and second portions are electrically coupled to each other to permit current flow to the electrically relatively non-insulative at least a portion of the shaft and the electrically relatively non-insulative at least a portion of the feed tube.

Illustratively according to this aspect of the invention, the electrically relatively non-insulative at least a portion of the feed tube comprises a metal tube.

Illustratively according to this aspect of the invention, the first and second portions comprise electrically relatively non-insulative brushes.

Illustratively according to this aspect of the invention, the electrically relatively non-insulative brushes comprise brushes having electrically relatively non-insulative resin or polymer bristles.

Illustratively according to this aspect of the invention, the electrically relatively non-insulative resin or polymer bristles comprise carbon-filled resin or polymer bristles.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
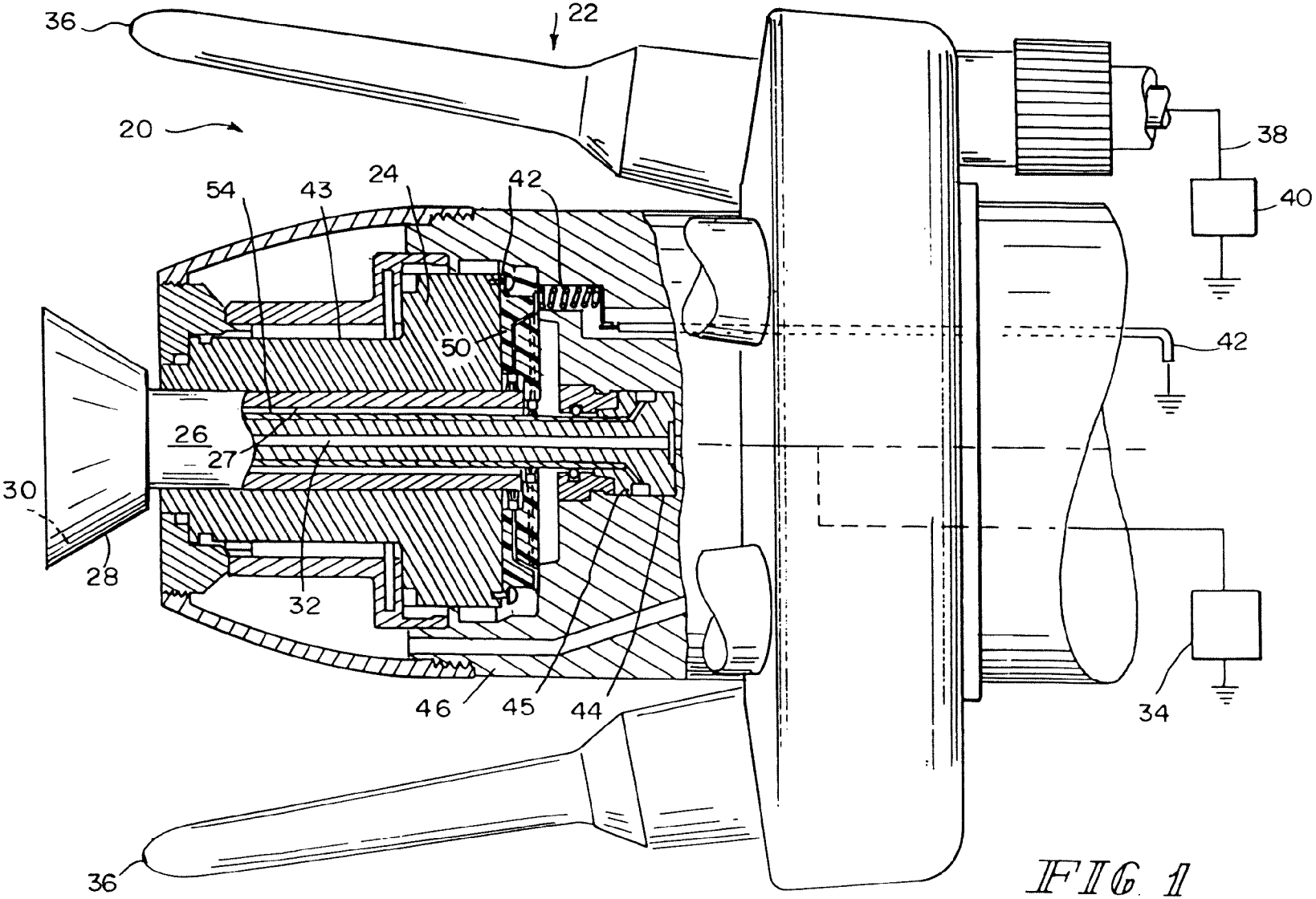
FIG. 1 illustrates a partly diagrammatic, partial fragmentary longitudinal sectional view of a system incorporating a device constructed according to the present invention.

FIG. 1 illustrates a rotary atomizer 20 for mounting, for example, on a robot arm (not shown). The atomizer includes an external charging device 22, and a turbine motor 24 for spinning an output shaft 26 upon which a bell cup 28 is mounted. Shaft 26 includes a passageway 27 extending the length thereof. Shaft 26 may be supported in an air bearing spindle which electrically isolates shaft 26 and the turbine wheel (not shown) which spins it from motor 24 housing 43.

Coating material to be atomized is supplied to the inner surface 30 of bell cup 28 through a feed tube 32 from a grounded coating material supply 34, all in accordance with known principles. External charging device 22 includes electrodes 36 which are coupled through conductors provided within device 22 and a high voltage cable 38 to a high magnitude potential source 40, for example, a source of the type illustrated and described in U.S. Pat. Nos. 6,562,137; 6,423,142; 6,144,570; 5,978,244; 5,159,544; 4,745,520; 4,485,427; 4,481,557; 4,324,812; 4,187,527; 4,075,677; 3,894,272; 3,875,892; and, 3,851,618. The turbine motor 24 and electrically non-insulative components electrically coupled thereto are grounded through a ground connection 42 to the turbine motor 24 housing 43.

The feed tube 32 typically is constructed from electrically non-insulative material, for example, stainless steel. Feed tube 32 is mounted at its rearward end 44 in a recess 45 provided for this purpose in an atomizer mounting manifold 46 typically constructed from electrically relatively non-conductive resin such as, for example, Delrin® acetal resin. See, for example, U.S. Pat. Nos. 5,622,563; 5,633,306; 5,662,278; and, 6,896,211. To promote grounding of feed tube 32 and thus charging of the coating material supplied through feed tube 32 to bell cup 28, it is desirable to couple feed tube 32 electrically to housing 43.

Figure 2:
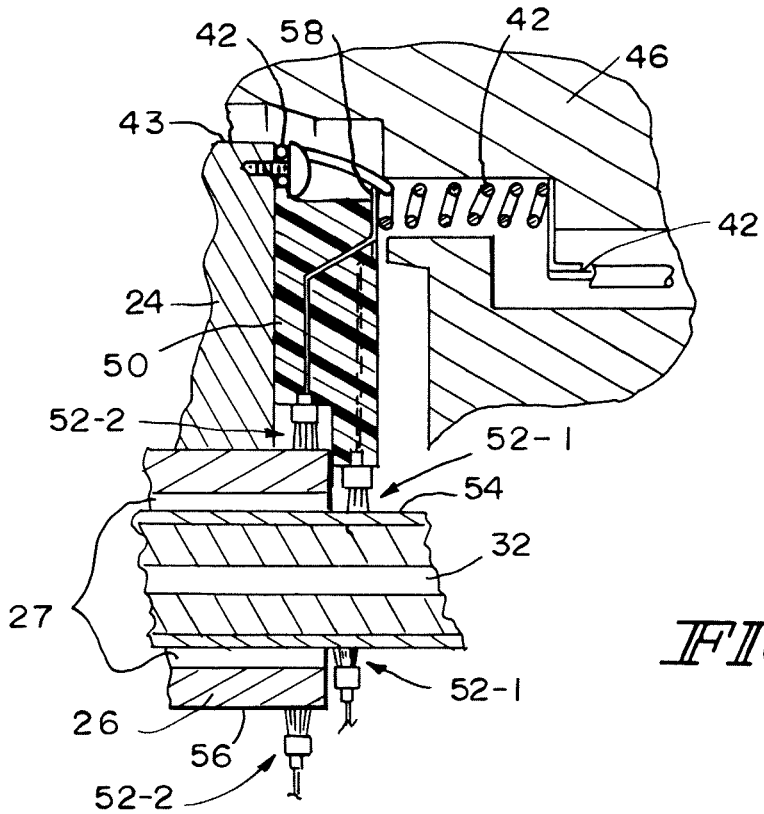
FIG. 2 illustrates an enlarged fragmentary longitudinal sectional view of a detail illustrated in FIG. 1.
Figure 3:
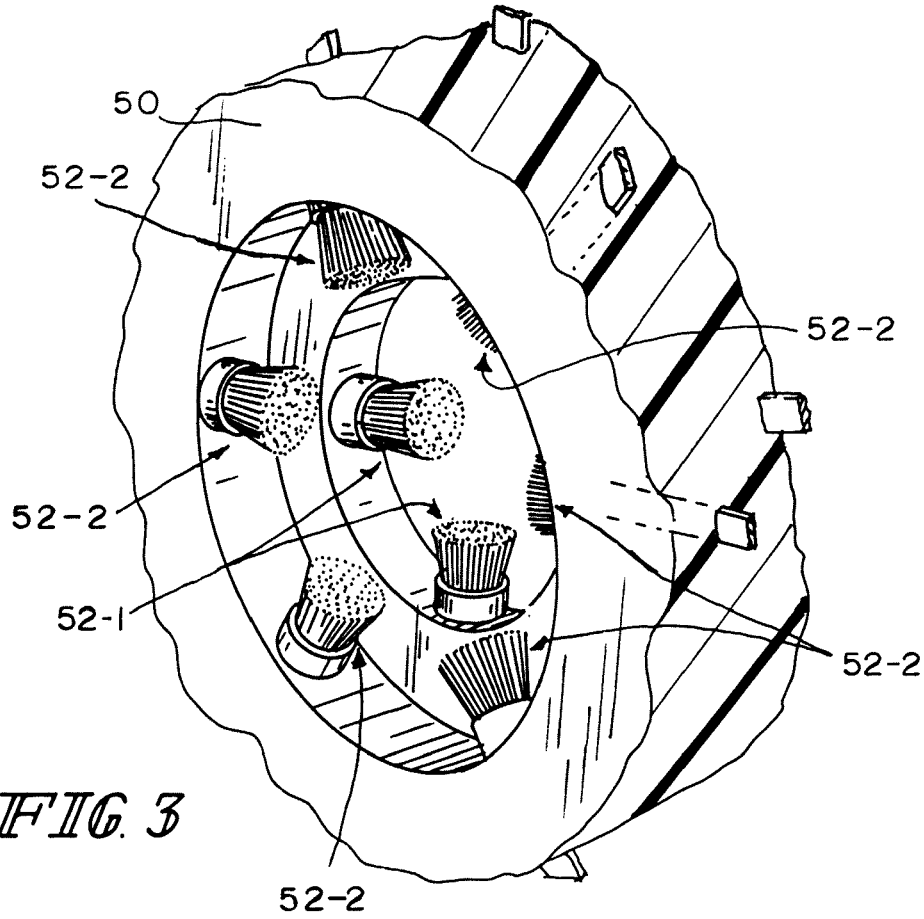
FIG. 3 illustrates an enlarged perspective view of a detail of the apparatus illustrated in FIGS. 1-2; and, FIG. 4 illustrates an enlarged fragmentary longitudinal sectional view of an alternative detail to the detail illustrated in FIG. 2.

Referring now particularly to FIGS. 2-3, a brush holder 50 is provided at the forward end (end toward bell cup 28) of manifold 46 around recess 45. Brush holder 50 includes a number, illustratively twelve, of radially inwardly projecting brushes 52 constructed from, for example, carbon filled resin strands. The carbon filling is sufficient to make the brushes 52 electrically non-insulative and provide the brushes 52 with relatively constant, relatively low impedances on the order of a few tenths of ohms to a few tens of ohms across the lengths of the brushes 52.

Brushes 52-1 are placed in the brush holder 50 so that, and are of sufficient length that, the free ends of the brushes 52-1 very lightly contact the outside surface 54 of electrically non-insulative feed tube 32 to provide relatively constant, relatively low impedances on the order of a few tenths of ohms to a few tens of ohms between surface 54 and the mountings of the brushes 52-1 in the brush holder 50.

Brushes 52-2 are placed in the brush holder 50 so that, and are of sufficient length that, the free ends of the brushes 52-2 lightly contact the outside surface 56 of electrically non-insulative shaft 26 to provide relatively constant, relatively low impedances on the order of a few tenths of ohms to a few tens of ohms between surface 56 and the mountings of the brushes 52-2 in the brush holder 50. The lengths of the brushes 52 and positioning of the brushes 52 adjacent surfaces 54, 56 are not such as to significantly load the motor 24, so that motor 24 control is not significantly compromised by the contact. The brushes 52 are all electrically coupled to each other and to turbine motor 24 housing 43 and/or directly to ground connection 42 through (an) electrical conductor(s), such as (a) length(s) of metal wire electrically connected to all of brushes 52, imbedded in brush holder 50 and providing an output terminal 58 facilitating electrical connection with turbine motor 24 housing 43 and/or directly to ground connection 42.

Figure 4:
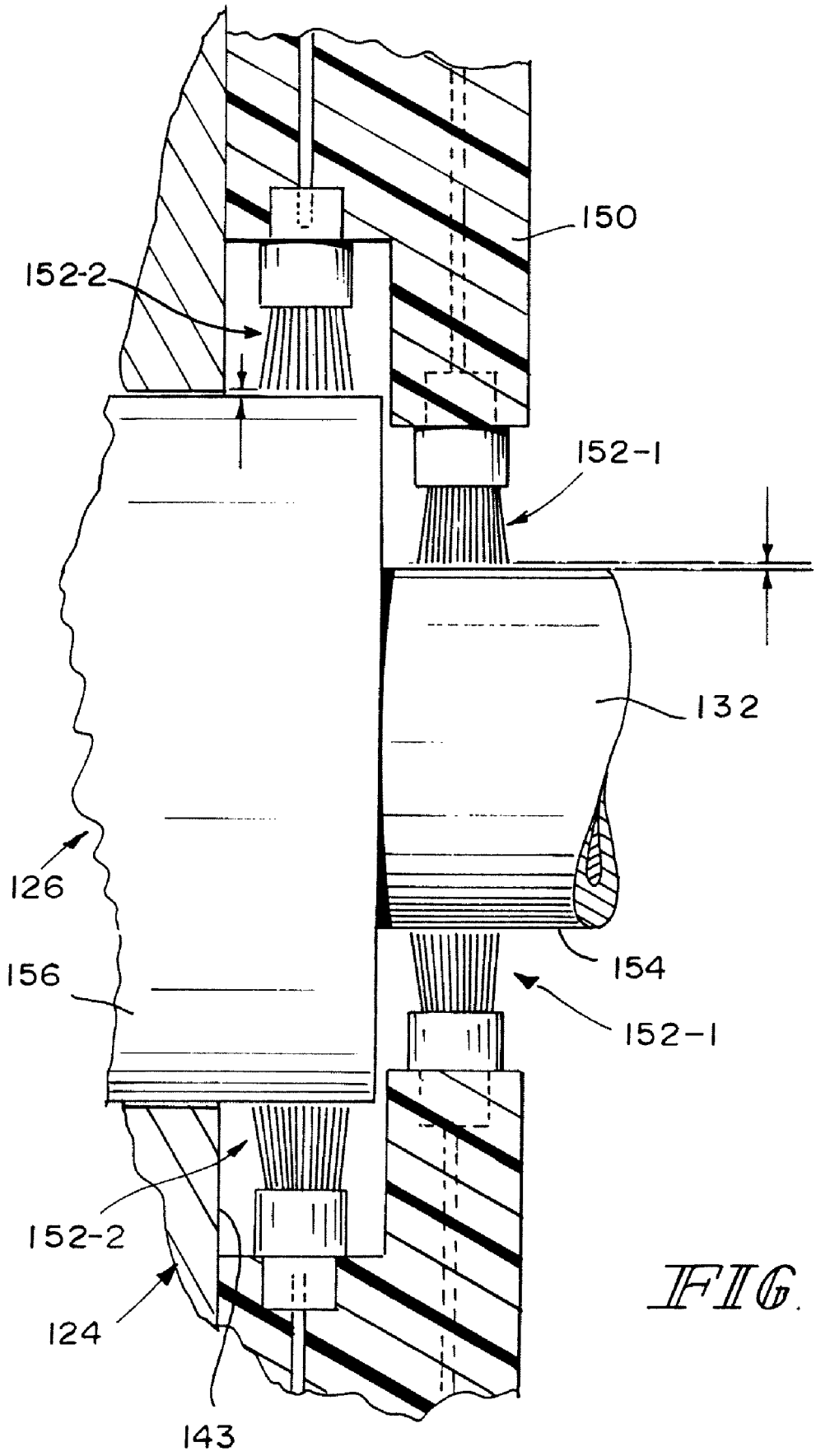

In another embodiment illustrated in FIG. 4, a brush holder 150 is provided at the forward end of a manifold (not shown). Brush holder 150 includes a number of radially inwardly projecting brushes 152 constructed from, for example, conductive polymer or resin strands. The conductive polymer or resin is sufficiently conductive to make the brushes 152 electrically non-insulative and provide the brushes 152 with relatively constant, relatively low impedances on the order of a few tenths of ohms to a few tens of ohms.

Brushes 152-1 are placed in the brush holder 150 so that, and are of sufficient length that, the free ends of the brushes 152-1 approach very closely (to within about 0.001 inch or so, about 0.025 mm or so), but do not contact, the outside surface 154 of an electrically non-insulative feed tube 132 to provide relatively constant, relatively low impedances on the order of a few tenths of ohms to a few tens of ohms between surface 154 and the mountings of the brushes 152-1 in the brush holder 150.

Brushes 152-2 are placed in the brush holder 150 so that, and are of sufficient length that, the free ends of the brushes 152-2 approach very closely (to within about 0.001 inch or so, about 0.025 mm or so), but do not contact, the outside surface 156 of an electrically non-insulative turbine 124 shaft 126 to provide relatively constant, relatively low impedances on the order of a few tenths of ohms to a few tens of ohms between surface 156 and the mountings of the brushes 152-2 in the brush holder 150. The mounting of the brushes 152 and positioning of the brushes 152 adjacent surfaces 154, 156 do not load the motor 124 in this embodiment since the brushes 152 do not physically contact surfaces 154, 156, so that motor 124 control is not compromised. The brushes 152 are all electrically coupled to each other and to turbine motor 124 housing 143 and/or directly to a ground connection, such as connection 42 in the embodiment illustrated in FIGS. 1-2 through (an) electrical conductor(s), such as (a) length(s) of metal wire electrically connected to all of brushes 152, imbedded in brush holder 150 and providing an output terminal, such as terminal 58 in the embodiment illustrated in FIGS. 1-2, facilitating connection with turbine motor 124 housing 143 and/or directly connected to ground connection, such as connection 42 in the embodiment illustrated in FIGS. 1-2.

Brushes 52, 152 may be of any suitable types and constructed from any suitable materials. By way of example only, and not by way of limitation, brushes 52, 152 can be of any suitable types described in U.S Patent Application Ser. No. 20060007609 or U.S Patent Application Ser. No. 20040233592. Also, while specific numbers of brushes 52, 152 are illustrated, it should be understood that a device constructed according to the present invention may include any suitable number of brushes, or a single continuous brush surrounding one or the other or both of feed tube 32, 132 and shaft 26, 126.

The disclosures of all of the references listed herein are hereby incorporated herein by reference. These listings are not intended to be representations that a complete search of all relevant art has been made, or that no more pertinent art than that listed exists, or that the listed art is material to patentability. Nor should any such representation be inferred.

What is claimed is:

1. A rotary atomizer including a motor for spinning an output shaft, at least a portion of the shaft being electrically relatively non-insulative, an atomizing device mounted on the shaft for rotation therewith, a passageway extending the length of the shaft, a feed tube extending through the passageway for supplying a coating material to be atomized to the atomizing device, at least a portion of the feed tube in contact with the coating material to be atomized as the coating material to be atomized flows through the feed tube toward the atomizing device being electrically relatively non-insulative, and a device for promoting electrical charging of the coating material to be atomized as the coating material to be atomized is in contact with the electrically relatively non-insulative at least a portion of the feed tube, the device for promoting electrical charging of the coating material including an electrically relatively non-insulative first portion in sufficiently close proximity to the electrically relatively non-insulative at least a portion of the shaft to provide relatively low resistance electrical charge transfer between the first portion and the electrically relatively non-insulative at least a portion of the shaft, and an electrically relatively non-insulative second portion extending in sufficiently close proximity to the electrically relatively non-insulative at least a portion of the feed tube to provide relatively low resistance electrical charge transfer between the second portion and the electrically relatively non-insulative at least a portion of the feed tube, the first and second portions being electrically coupled to each other to permit current flow to the electrically relatively non-insulative at least a portion of the shaft and the electrically relatively non-insulative at least a portion of the feed tube, the first and second portions comprising electrically relatively non-insulative brushes.

2. The rotary atomizer of claim 1 wherein the electrically relatively non-insulative brushes comprise brushes having electrically relatively non-insulative resin or polymer bristles.

3. The rotary atomizer of claim 2 wherein the electrically relatively non-insulative resin or polymer bristles comprise carbon-filled resin or polymer bristles.

4. A rotary atomizer including a motor for spinning an output shaft, at least a portion of the shaft being electrically relatively non-insulative, an atomizing device mounted on the shaft for rotation therewith, a passageway extending the length of the shaft, a feed tube extending through the passageway for supplying a coating material to be atomized to the atomizing device, at least a portion of the feed tube in contact with the coating material to be atomized as the coating material to be atomized flows through the feed tube toward the atomizing device being electrically relatively non-insulative, and a device for promoting electrical charging of the coating material to be atomized as the coating material to be atomized is in contact with the electrically relatively non-insulative at least a portion of the feed tube, the device for promoting electrical charging of the coating material including an electrically relatively non-insulative first portion in sufficiently close proximity to the electrically relatively non-insulative at least a portion of the shaft to provide relatively low resistance electrical charge transfer between the first portion and the electrically relatively non-insulative at least a portion of the shaft, and an electrically relatively non-insulative second portion extending in sufficiently close proximity to the electrically relatively non-insulative at least a portion of the feed tube to provide relatively low resistance electrical charge transfer between the second portion and the electrically relatively non-insulative at least a portion of the feed tube, the first and second portions being electrically coupled to each other to permit current flow to the electrically relatively non-insulative at least a portion of the shaft and the electrically relatively non-insulative at least a portion of the feed tube, the first portion comprising at least one electrically relatively non-insulative brush.

5. The rotary atomizer of claim 4 wherein the at least one electrically relatively non-insulative brush comprises at least one brush having electrically relatively non-insulative resin or polymer bristles.

6. The rotary atomizer of claim 5 wherein the electrically relatively non-insulative resin or polymer bristles comprise carbon-filled resin or polymer bristles.

7. A rotary atomizer including a motor for spinning an output shaft, at least a portion of the shaft being electrically relatively non-insulative, an atomizing device mounted on the shaft for rotation therewith, a passageway extending the length of the shaft, a feed tube extending through the passageway for supplying a coating material to be atomized to the atomizing device, at least a portion of the feed tube in contact with the coating material to be atomized as the coating material to be atomized flows through the feed tube toward the atomizing device being electrically relatively non-insulative, and a device for promoting electrical charging of the coating material to be atomized as the coating material to be atomized is in contact with the electrically relatively non-insulative at least a portion of the feed tube, the device for promoting electrical charging of the coating material including an electrically relatively non-insulative first portion in sufficiently close proximity to the electrically relatively non-insulative at least a portion of the shaft to provide relatively low resistance electrical charge transfer between the first portion and the electrically relatively non-insulative at least a portion of the shaft, and an electrically relatively non-insulative second portion extending in sufficiently close proximity to the electrically relatively non-insulative at least a portion of the feed tube to provide relatively low resistance electrical charge transfer between the second portion and the electrically relatively non-insulative at least a portion of the feed tube, the first and second portions being electrically coupled to each other to permit current flow to the electrically relatively non-insulative at least a portion of the shaft and the electrically relatively non-insulative at least a portion of the feed tube, the second portion comprising at least one electrically relatively non-insulative brush.

8. The rotary atomizer of claim 7 wherein the at least one electrically relatively non-insulative brush comprises at least one brush having electrically relatively non-insulative resin or polymer bristles.

9. The rotary atomizer of claim 8 wherein the electrically relatively non-insulative resin or polymer bristles comprise carbon-filled resin or polymer bristles.

* * * * *